US006238189B1

(12) United States Patent
Guentert

(10) Patent No.: US 6,238,189 B1
(45) Date of Patent: May 29, 2001

(54) RADIAL PISTON PUMP FOR HIGH-PRESSURE FUEL SUPPLY

(75) Inventor: Josef Guentert, Gerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/254,448

(22) PCT Filed: Jun. 30, 1998

(86) PCT No.: PCT/DE98/01790

§ 371 Date: Mar. 10, 1999

§ 102(e) Date: Mar. 10, 1999

(87) PCT Pub. No.: WO99/02857

PCT Pub. Date: Jan. 21, 1999

(30) Foreign Application Priority Data

Jul. 11, 1997 (DE) ..... 197 29 792
Apr. 1, 1998 (DE) ..... 198 14 477

(51) Int. Cl.[7] ..... F04B 27/04
(52) U.S. Cl. ..... 417/273; 417/454
(58) Field of Search ..... 417/273, 454, 417/366

(56) References Cited

U.S. PATENT DOCUMENTS 4,952,121 * 8/1990 De Matthaeis et al. ..... 417/273
4,957,416 * 9/1990 Miller et al. ..... 417/273
5,382,140 * 1/1995 Eisenbacher et al. ..... 417/273
5,395,219 * 3/1995 Hosoya et al. ..... 417/454
6,162,022 * 12/2000 Anderson et al. ..... 417/273

* cited by examiner

*Primary Examiner*—Cheryl J. Tyler
(74) *Attorney, Agent, or Firm*—Ronald E. Greigg; Edwin E. Greigg

(57) ABSTRACT

A radial piston pump for a high-pressure fuel supply in fuel injection systems of internal combustion engines includes a drive shaft, supported in a pump housing, and a plurality of pistons disposed radially with respect to the drive shaft in respective cylinder chambers. The pistons are movable back and forth in the radial direction, and for each piston, one metal insert part forming the respective cylinder chamber is provided inside the housing and radially to the drive shaft to communicate with the intake side and with the high-pressure side. The respective insert part in the direction of the drive shaft between two flangelike metal housing parts with bearing faces extend perpendicular to the drive shaft and rests on these faces. The respective insert part has a fuel delivery opening and a fuel discharge opening, which discharges in the region of the bearing faces and are aligned with a further respective delivery and discharge opening in the housing parts. The flangelike housing parts are tightened against one another, with the interposition of the insert parts, in such a way that the bearing faces of the respective insert part and housing parts effect high-pressure sealing with the interposition of sealing elements.

13 Claims, 3 Drawing Sheets

RADIAL PISTON PUMP FOR HIGH-PRESSURE FUEL SUPPLY

BACKGROUND OF THE INVENTION

The invention relates to a radial piston pump for high-pressure fuel supply in fuel injection systems of internal combustion engines, in particular in a fuel injection system, having a drive shaft. The pump piston is supported in a pump housing and embodied eccentrically or has a plurality of camlike protuberances in the circumferential direction. Preferably a plurality of pistons are disposed radially with respect to the drive shaft in a given cylinder chamber, which upon rotation of the drive shaft the pistons are movable radially back and forth in the cylinder chamber. Each of the face ends remote from the drive shaft define a suction or compressor chamber, and have check valves on the intake side and the high-pressure side.

A radial piston pump of this type is sold by Applicant under the brand name CP1. In such a previously known pump, the mounting forces are initiated via a plurality of components braced against one another. For sealing, a number of elastomer sealing elements are used.

OBJECTS AND SUMMARY OF THE INVENTION

With this as the point of departure, it is an object of the present invention to create a radial piston pump that is high-pressure proof up to 2000 bar, with little idle volume and correspondingly high efficiency, in which the components are acted upon by high pressure and their sealing points are decoupled from one another and are defined statically exactly.

In the radial piston pump of the type described at the outset, this object is attained according to the invention in that for each piston, one metal insert part forming the respective cylinder chamber is provided inside the housing and radially to the drive shaft. The metal insert and communicates with the intake side and with the high-pressure side, and that the respective insert part, in the direction of the drive shaft between two flangelike metal housing parts with bearing faces extending perpendicular to the drive shaft rests on these faces. The respective insert part has a fuel delivery opening and a fuel discharge opening, which discharge in the region of the bearing faces and are aligned with a further respective delivery and discharge opening in the housing parts. The flangelike housing parts are tightened against one another, with the interposition of the insert parts, in such a way that the bearing faces of the respective insert part and housing parts effect a high-pressure sealing without the interposition of sealing elements.

While in previously known radial piston pumps the high-pressure sealing has also been attained via elastomeric, more or less deforming sealing elements and the mounting of the components defining the high-pressure side included—as noted at the outset—a flow of force via a plurality of components, which led to a static indefiniteness, with the invention it is proposed that the sealing be attained via metal sealing faces of the insert part and of the flangelike housing parts that extend at right angles to the drive shaft. To that end, the fuel delivery and discharge during the pumping stroke of the pump pistons are effected via fuel delivery openings and fuel discharge openings, which discharge at one end in the intake or compressor chamber and on the other in the sealing faces on both sides. The insert part now rests in a statically precisely determined way against the two flangelike housing parts, without the interposition of any sealing elements of any kind. When the housing parts are tightened against one another, a so-called hard sealing is effected by means of the metal bearing faces of the insert part and of the flangelike housing parts on both sides.

Preferably, all the sealing points, acted upon by high pressure, of metal components tightened against one another are formed without the interposition of additional sealing elements, that is, so-called hard seals.

The metal components resting sealingly against one another preferably have lapped bearing faces. By means of the lapping operation, a desired surface roughness is created while maintaining the dimensional accuracy.

From the standpoint of production technology, it is proved to be especially advantageous if the respective insert part is positioned relative to the housing parts via pins extending parallel to the drive shaft.

If the check valve on the intake side and on the high-pressure side, respectively, is integrated with the respective housing part; and the downstream side of the check valve on the high-pressure side extends as far as a high-pressure connection stub entirely inside the housing part, then the high-pressure side is sealed off securely by the hard (only) seal between the insert part and the housing part.

The aforementioned high-pressure connection stub is preferably tightened with one face end against a step, forming a direct metal-to-metal seal. The metal seal is advantageously embodied such that the sealing faces resting on one another of the metal components have a sharp-edged or beadlike protuberance, which when the components are tightened against one another leads to a sealing plastic deformation along the protuberance. This is known as a biting edge seal. In the case of the high-pressure connection stub, this biting edge is preferably provided extending all the way around on the face end.

The insert part extending radially to the drive shaft could have a blind bore to form the cylinder chamber. However, to enable machining the wall of the cylinder chamber in a suitable way, for instance by lapping, it proves to be advantageous if the insert part has a through opening, extending radially to the drive shaft and forming the cylinder chamber, which opening is closed radially on the outside by a metal closing element that is screwed into the through opening.

To form a high-pressure seal, the metal closing element is tightened with its face end against an axial step in the through opening in such a way that high-pressure sealing is brought about. To that end, the face end of the closing element may have an encompassing biting edge, which when the closing element is tightened forms a sealing plastic deformation with the axial step face.

BRIEF DESCRIPTION OF THE DRAWINGS

Further characteristics, details and advantages of the invention will become apparent from the drawing and the ensuing description of a preferred embodiment of the radial piston pump of the invention. Shown in the drawing are.

DETAILED DESCRIPTION

Figure 1:
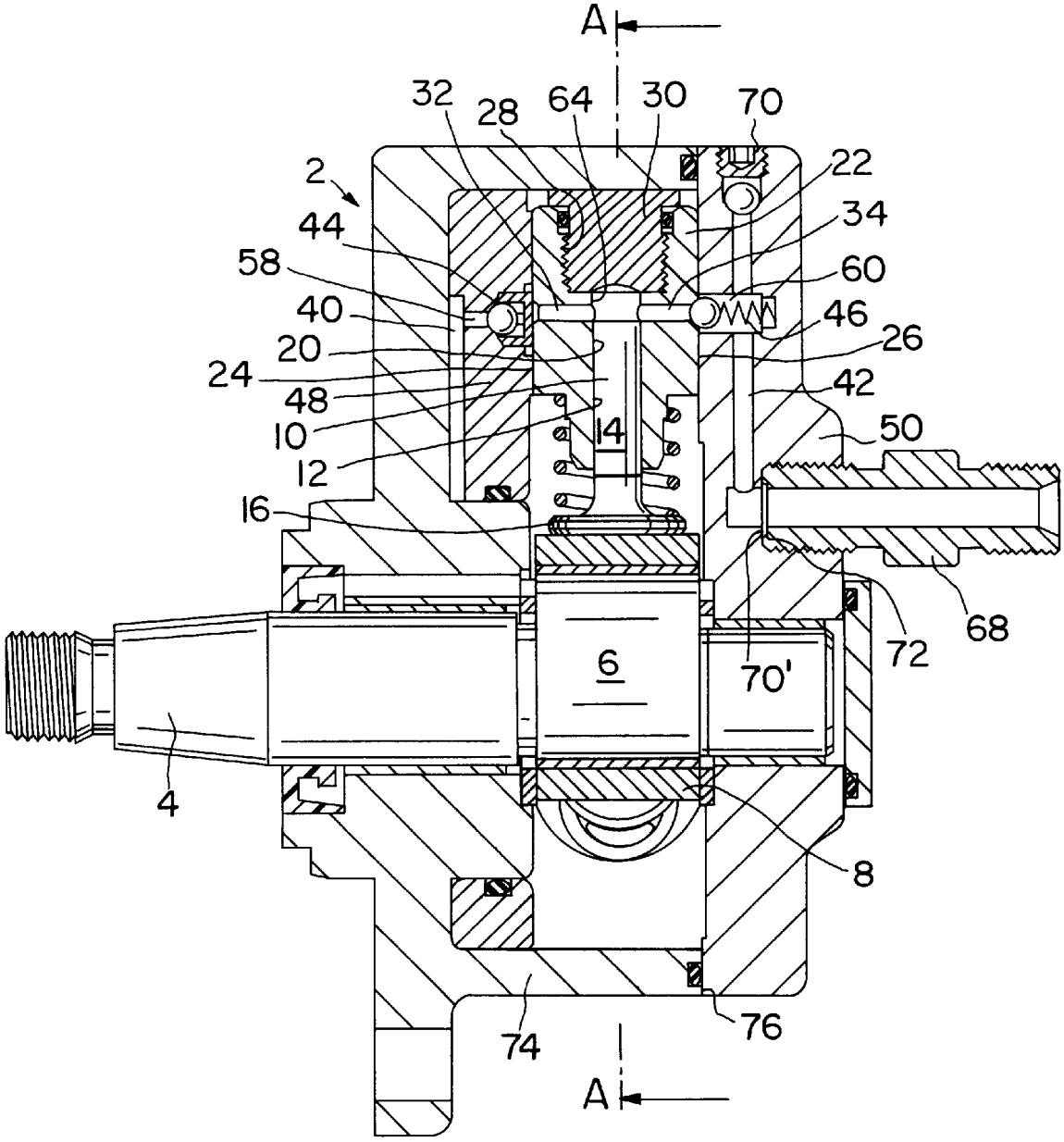
FIG. 1, a longitudinal section through a radial piston pump of the invention.
Figure 2:
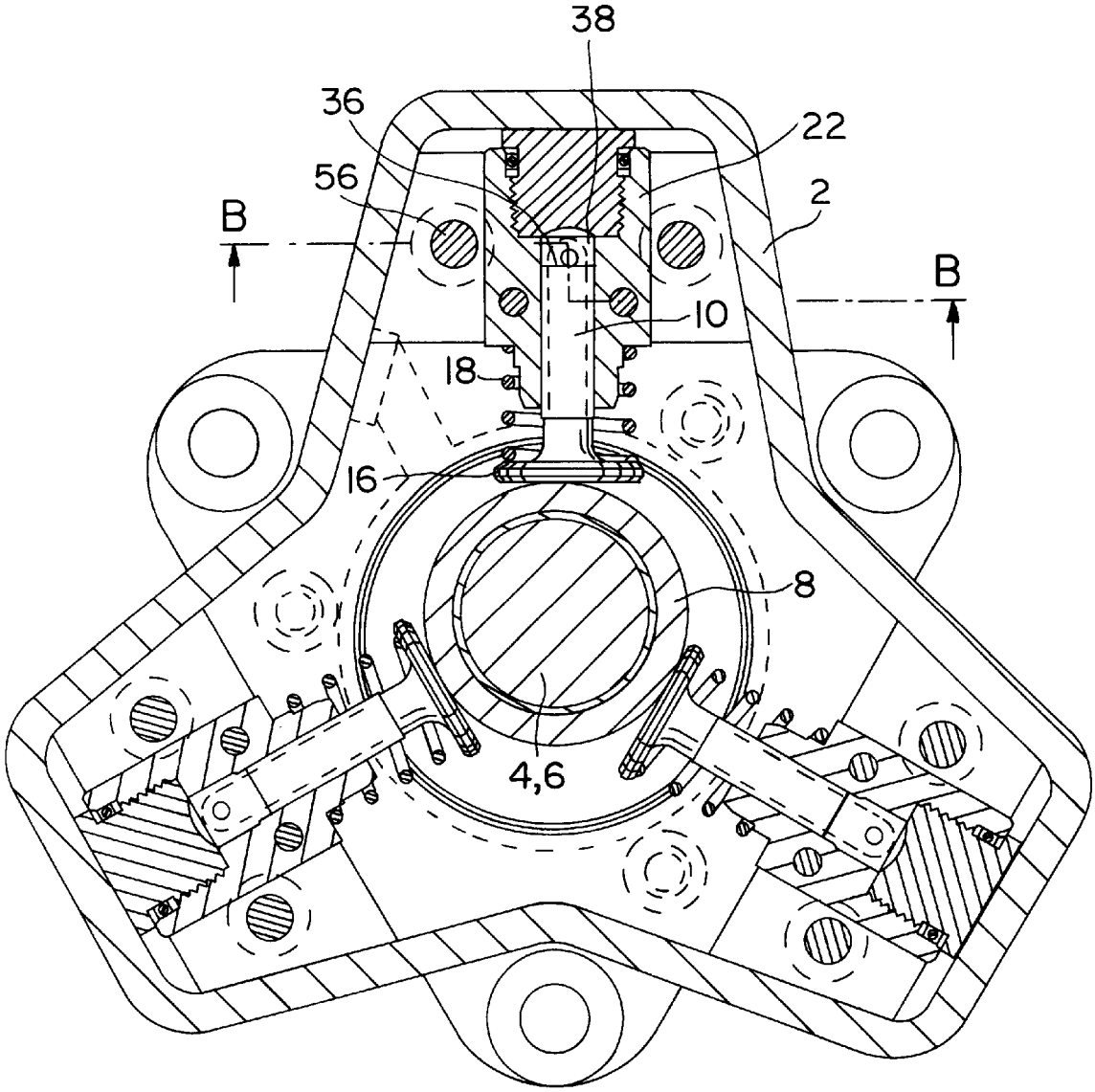
FIG. 2, a section taken along the line A—A in FIG. 1.

FIGS. 1 and 2 show a radial piston pump for high-pressure fuel supply in fuel injection systems, in particular fuel injection systems, of internal combustion engines. The radial piston pump is designed to have an integrated supply quantity control. As the control concept, the principle of intake throttle control is employed. Fuel delivery and fuel dimensioning are done via a metering unit, not shown.

Figure 4:
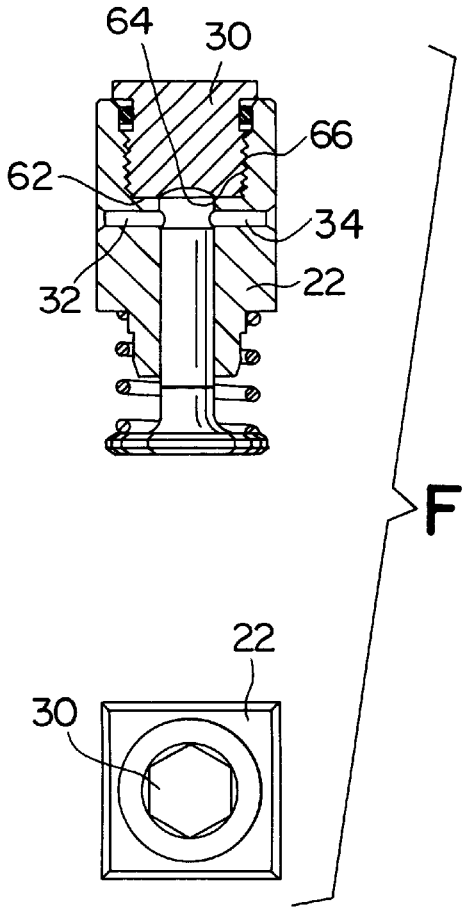
FIG. 4, a detail showing the insert part, forming the cylinder chamber, of the radial piston pump.

The radial piston pump includes a drive shaft 4, supported in a pump housing designated overall by reference numeral 2, with an eccentrically embodied shaft portion 6. On the eccentric shaft portion 6, an outlet bush 8 is provided, relative to which the shaft portion 6 is rotatable. Three pistons 10, offset from one another by 120° each in the radial direction, are braced against the outer jacket face of the outlet bush 8. The pistons 10 include a tappet 14, guided in a cylinder chamber 12, on the end toward the drive shaft 4 of which tappet a platelike bearing portion 16 is formed, with which the respective piston 10 is braced against the outer jacket face of the outlet bush 8 by the prestressing of a spring 18. The cylinder chamber 12 of a given tappet 14 of the pump pistons 10 is formed by a through opening 20, extending radially to the drive shaft 4 in an insert part 22 (FIG. 4). The insert part 22 is embodied essentially in blocklike shape, having at least two flat side faces (24 and 26) extending parallel to one another. The insert part 22 is disposed so that its through opening 20, which forms the cylinder chamber 12, is radial to the drive shaft 4, in accordance with the position of the pump pistons 10. The through opening 20 is embodied in stepped form and has a larger-diameter, widened end portion 28 on the side remote from the drive shaft 4. A closing element 30, embodied as a screw, is screwed into this end portion 28 in order to seal off the cylinder chamber 12 from the outside in a manner to be described in further detail hereinafter. Also provided in the insert part 22 are a fuel delivery opening 32 and a fuel discharge opening 34, which extend radially outward from the cylinder chamber 12 and discharge in the aforementioned parallel side faces 24, 26. Inside the cylinder chamber 12, the closing element 30 and an end face 36, remote from the drive shaft 4, of the pump piston 10 define a suction or compressor chamber 38, which via the delivery opening 32 and the discharge opening 34 communicate respectively with an intake side 40 and a high-pressure side 42; respective check valves 44 and 46 are provided on the intake side and on the high-pressure side.

Figure 3:
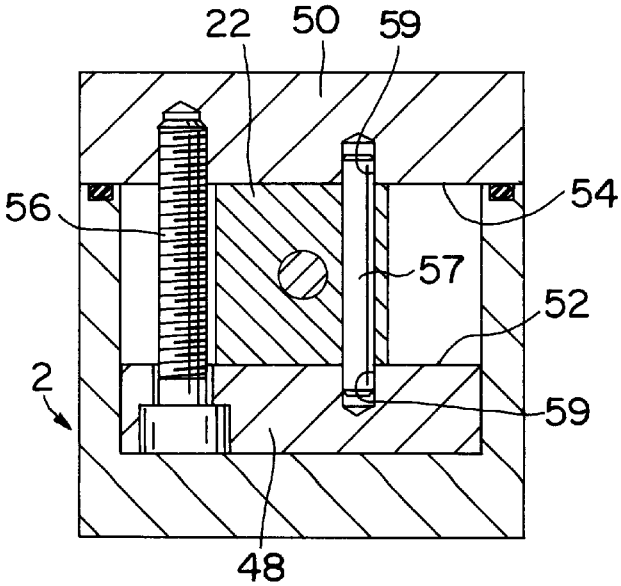
FIG. 3, a section taken along the offset line B—B in FIG. 2.

As can be seen in detail from FIGS. 1 and 3, the insert part 22 is disposed in the direction of the drive shaft 4 between two flangelike metal housing parts 48, 50 . The housing parts 48, 50 also have plane bearing faces 52, 54, which rest against the parallel side faces 24, 26 of the insert part 22, forming a so-called hard seal. The plane bearing faces 52, 54 of the flangelike housing parts 48, 50 extend in the same plane without any encompassing edge or other protrusion projecting past the respective bearing face 52, 54. The surface of these housing parts 48, 50 is therefore very readily machined; they are preferably lapped, in order to produce a suitable surface property (peak to valley depth of . . . ). The flangelike housing parts 48, 50 are tightened against one another by means of screws 56 (FIGS. 2, 3), with the interposition of the insert part 22, in such a way that the bearing faces 52, 54 and 24, 26 of the housing parts and insert part, respectively, are pressed together, resting over their entire surface against one another, in such a way that high-pressure sealing is brought about. The fuel delivery opening 32 and fuel discharge opening 34 discharging respectively in the bearing face 24 and 26 are aligned with a further fuel delivery conduit 58 in the flangelike housing part 48 and with a high-pressure, fuel discharge conduit 60 in the other flangelike housing part 50, respectively. The areal contact of the insert part 22 with the housing parts 48, 50 effectively seals off the fuel delivery and fuel discharge without having to use any additional sealing elements whatever that would make a statically exact definition of the parts mounted against one another questionable. To enable putting the insert part 22 into an exact mounting position with respect to the flangelike housing parts, two positioning pins 57, extending parallel to the screws 56, are each used; they extend parallel to the drive shaft 4 through precisely dimensioned through bores through the insert part 22 and plunge into blind bores 59 in the flangelike housing part 48 and 50, respectively. The check valve 44 on the low-pressure side and the check valve 46 on the high-pressure side, already mentioned above, are accommodated in a widened portion of the fuel delivery conduit 58 and the fuel high pressure discharge conduit 60, respectively, outside the insert part 22.

To seal off the cylinder chamber 12 by means of the closing element 30 screwed into the larger-diameter widened end portion 28 of the through opening 20, the closing element has a circularly encompassing biting edge 64 on its face end 62 toward the piston as shown in FIG. 4. This term biting edge 64 should be understood to mean an encompassing beadlike protuberance that preferably forms an edge which is embodied against an axial step 66 between the wider-diameter portion 28 and the cylinder chamber 12. Tightening the closing element 30 creates a high-pressure-sealing plastic deformation of the biting edge 64 and axial step 66.

The fuel discharge conduit 60 that forms the high-pressure side 42 extends entirely inside the flangelike housing part 50. That is, the high-pressure side 42 is sealed off and surrounded by the hard seal, explained above, between the insert part 22 and the flangelike housing parts 48, 50; it is supplemented only by a high-pressure connection stub 68 and an overpressure valve 70, which are both defined statically exactly relative to the flangelike housing part 50. The high-pressure connection stub 68 has a biting edge 70', corresponding to the biting edge 64 of the closing element 30, which is tightened sealingly against a circularly encompassing shoulder 72.

In the operation of the radial piston pump, upon further rotation of the drive shaft 6, the pump piston is moved, beginning at the position in FIGS. 1 and 2, out of the cylinder chamber 12 by 180° under the influence of the prestressing of the spring 18. The pressure in the intake or compressor chamber 38 drops. Once it drops below a predetermined opening pressure, the check valve 46 on the high-pressure side closes, and under the influence of the pilot pressure prevailing on the intake side 40 the check valve 44 on the intake side opens, so that fuel is aspirated into the intake or compressor chamber 38 during this intake stroke of the piston 10. Upon further rotation of the drive shaft 4, the piston is moved back into the cylinder chamber 12 by the eccentric shaft portion 6 or the outlet bush 8. The check valve 44 on the intake side closes, and once the opening pressure is exceeded the check valve 46 on the high-pressure side is opened, and the fuel compressed to high pressure is pumped to an engine piston or to a high-pressure storage chamber of a fuel injection system via the high-pressure conduit 60 and the high-pressure connection stub 68.

The radial piston pump of the invention is high-pressureproof to 2000 bar; the check valves 44 and 46 are located close to the intake or compressor chamber 38, so that the idle volume is very low and the efficiency of the pump is correspondingly high. Because of the statically precisely defined contact of the insert part 22 with the flangelike housing parts 48, 50, all the sealing locations on the high-pressure side are formed by the hard seal as defined above. Thus the sealing forces are initiated and braced in a defined way.

The flangelike housing part 48 on the low-pressure side and the insert part 22 are flashed by a housing shell of aluminum, which has an encompassing cylinder wall 74, whose face end 76 toward the housing part 50 rests on the housing part 50 via an elastomer sealing element, forming a low-pressure seal.

The foregoing relates to a preferred exemplary embodiment of the invention, it being understood that other variants and embodiments thereof are possible within the spirit and scope of the invention, the latter being defined by the appended claims.

What is claimed is:

1. A radial piston pump for a high-pressure fuel supply in fuel injection systems of internal combustion engines, comprising a drive shaft (4), which is supported in a pump housing (2) and embodied as one of an eccentric drive and camlike protuberances in a circumferential direction, a plurality of pistons (10), disposed radially with respect to the drive shaft (4) in a respective cylinder chamber (12) of a metal insert part (22), upon rotation of the drive shaft (4) the pistons are movably radially back and forth in the respective cylinder chamber, each piston includes a face end (36) remote from the drive shaft (4), each face end defines one of a suction and compressor chamber (38), an intake check valve (44) on an intake side in a first metal housing part (40) and an output check-valve (46) on a high-pressure side (42) in a second metal housing part (50) are provided, respectively for each piston (10), the metal insert part (22) forming the respective cylinder chamber (12) is provided inside the housing (2) and radially to the drive shaft (4), the cylinder chamber communicates with the intake side of the first metal housing part (40) and with the high-pressure side (42) of the second metal housing part (50), and that the respective metal insert part (22), is directed in a direction toward the drive shaft (4) between the first and second metal housing parts (48, 50) which include bearing faces (24, 26; 52, 54) extending perpendicular to the drive shaft with the respective metal insert part (22) resting on the bearing faces; and the respective metal insert part (22) has a fuel delivery opening (32) and a fuel discharge opening (34), the fuel discharge opening discharges in a region of the bearing faces and is aligned with a further respective delivery opening (58) and discharge opening (60) in the first and second metal housing parts (48, 50); and the first and second metal housing parts (48, 50) are tightened against one another, with an interposition of the metal insert part (22), in such a way that the bearing faces (24, 26; 52, 54) of the respective metal insert part (22) and first and second metal housing parts (48, 50) bring about high-pressure sealing without the interposition of sealing elements, and the intake check valves (44) on the intake side and output check valve (46) on the high-pressure side, respectively, are integrated with the first housing part (48) and the second housing part (50), respectively; and that a downstream side of the output check valve (46) on the high-pressure side extends as far as a high-pressure connection stub (68) with the high-pressure side extending entirely inside the second metal housing part (50).

2. The radial piston pump according to claim 1, in which the metal components (48, 50, 22) resting sealingly against one another have lapped bearing faces (24, 26, 52, 54).

3. The radial piston pump according to claim 2, in which the respective insert part (22) is positioned relative to the metal housing parts (48, 50) via pins (57) extending through the insert part parallel to the drive shaft (4).

4. The radial piston pump according to claim 2, in which the high-pressure connection stub (68) is tightened with one face end against a step (72), forming a direct metal-to-metal seal.

5. The radial piston pump according to claim 1, in which the respective insert part (22) is positioned relative to the metal housing parts (48, 50) via pins (57) extending through the insert part parallel to the drive shaft (4).

6. The radial piston pump according to claim 5, in which the high-pressure connection stub (68) is tightened with one face end against a step (72), forming a direct metal-to-metal seal.

7. The radial piston pump according to claim 1, in which the high-pressure connection stub (68) is tightened with one face end against a step (72), forming a direct metal-to-metal seal.

8. The radial piston pump according to claim 7, in which the high-pressure connection stub (68) has an encompassing biting edge (70) on its face end.

9. The radial piston pump according to claim 1, in which in one of the sealing faces (62, 66), resting against one another, of the metal housing parts (30, 22; 48, 50), one of a sharp-edged and bead-like protuberance (64, 70) is formed, which when the components are tightened against one another leads to a fixed sealing plastic deformation along the protuberance.

10. The radial piston pump according to claim 9, in which the high-pressure connection stub (68) has an encompassing biting edge (70) on its face end.

11. The radial piston pump according to claim 1, in which the insert part (22) has a through opening (20), extending radially to the drive shaft (4) and forming the cylinder chamber (12), which opening is closed radially on the outside by a metal closing element (30) that is screwed into the through opening.

12. The radial piston pump according to claim 11, in which the metal closing element (30) is tightened with its face end (62) against an axial step (66) in the through opening (20) in such a way that a high-pressure sealing is brought about.

13. The radial piston pump according to claim 12, in which an encompassing biting edge (64) is embodied on the face end (62) of the closing element (30).

* * * * *